United States Patent [19]

Toyoshima et al.

[11] 4,456,900

[45] Jun. 26, 1984

[54] HIGH FREQUENCY COIL

[75] Inventors: Yohtaro Toyoshima; Yasuhiro Sasaki; Minoru Uchida, all of Tokyo, Japan

[73] Assignees: TDK Electronics Co., Ltd., Tokyo; NGK Spark Plug Co., Ltd., Nagoya, both of Japan

[21] Appl. No.: 260,986

[22] Filed: May 6, 1981

[30] Foreign Application Priority Data

May 23, 1980 [JP] Japan ..... 55-71035[U]
Sep. 12, 1980 [JP] Japan ..... 55-129119[U]
Mar. 2, 1981 [JP] Japan ..... 56-29509[U]

[51] Int. Cl.[3] ..... H01F 17/04

[52] U.S. Cl. ..... 336/221; 336/100; 338/66; 315/41; 315/58; 315/59; 315/62; 335/248; 335/257; 335/277

[58] Field of Search ..... 336/100; 338/66; 315/41, 58, 59, 62; 335/248, 257, 277

[56] References Cited

U.S. PATENT DOCUMENTS 2,672,577 3/1954 Thies ..... 315/58

*Primary Examiner*—J. V. Truhe
*Assistant Examiner*—Susan Steward
*Attorney, Agent, or Firm*—Oblon, Fisher, Spivak, McClelland & Maier

[57] ABSTRACT

A high frequency coil including an inductance device formed by fitting a pair of electrode caps at both ends of a ferrite magnetic core wound by a winding on a peripheral surface of the core; a heat resistant electric insulating coated layer formed on the peripheral surface of the inductance device and a heat resistant electric insulating resilient tube fitted onto the peripheral surface of the coated inductance device.

7 Claims, 10 Drawing Figures

HIGH FREQUENCY COIL

BACKGROUND OF THE INVENTION

1. Field of the Invention

The present invention relates to a high frequency coil which is used as a noise suppressor in an ignition plug.

2. Description of the Prior Arts

One embodiment of the conventional high frequency coil is shown in FIG. 1 wherein windings (2) of bare wires are wound on a peripheral surface of a cylindrical ferrite magnetic core (1) in a space to form a coil and metallic cup-shaped electrode caps (3) are fitted at both ends of the ferrite magnetic core (1) and inner walls of the electrode caps (3) are respectively connected to both ends of the winding (2) wound on the ferrite magnetic core (1) to form an inductance device and a heat resistant electric insulating paint (4) is coated on the peripheral part of the inductance device between the electrode caps (3).

When the conventional high frequency coil is fitted by a spring (14) between a center electrode (12) and a terminal electrode (13) in a hollow insulator (11) of the ignition plug (10) shown in FIG. 2, a gap (g) between each electrode cap (3) and an inner wall of the hollow insulator (11) causes weak impact strength whereby it is not satisfactory in the impact strength test of Japanese Industrial Standard B-8031.

SUMMARY OF THE INVENTION

It is an object of the present invention to improve the disadvantages of conventional high frequency coils for an ignition plug.

It is another object of the present invention to provide a high frequency coil which has a desired impact strength.

The foregoing and other objects of the present invention have been attained by providing a high frequency coil which comprises an inductance device formed by fitting a pair of electrode caps at both ends of a ferrite magnetic core wound by a winding on the peripheral surface of the core; a heat resistant electric insulating coated layer formed on the peripheral surface of the inductance device and a heat resistant electric insulating resilient tube fitted onto the peripheral surface of the coated inductance device.

DETAILED DESCRIPTION OF THE PREFERRED EMBODIMENTS

Figure 1:
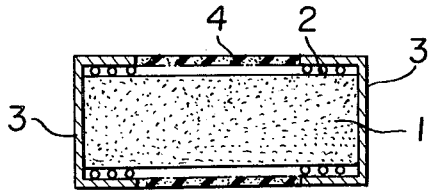
FIG. 1 is a sectional view of the conventional high frequency coil.
Figure 2:
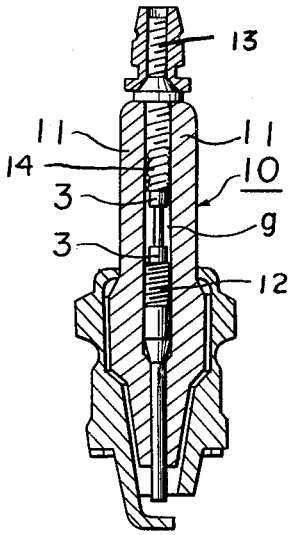
FIG. 2 is a sectional view of an ignition plug in which the high frequency coil is used.
Figure 3:
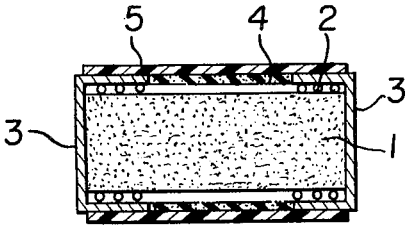
FIG. 3 is a sectional view of one embodiment of a high frequency coil of the present invention.
Figure 4:
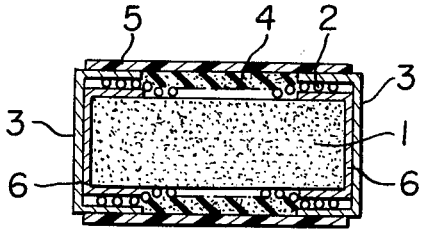
FIG. 4 is a sectional view of the other embodiment of the high frequency coil of the present invention.

Referring to FIGS. 3 and 4, the embodiments of the high frequency coil of the present invention will be illustrated.

The parts corresponding to those of the conventional device are referred by the same references.

FIG. 3 shows the basical structure of the embodiment of the present invention. The reference numeral (1) designates a rod ferrite magnetic core; (2) designates windings of bare wire wound in a space form to form a coil; (3) designates a metallic electrode cup-shaped cap. The windings (2) are wound on the peripheral surface of the rod ferrite magnetic core (1) and the metallic cup-shaped electrode caps (3) are fitted to both ends of the ferrite magnetic core (1) and each inner wall of the electrode cap (3) is connected to each end of the winding (2) wound on the ferrite magnetic core (1) to form an inductance device. A heat resistant electric insulating paint (4) is coated on the peripheral surface of the inductance device between the electrode caps (3) and the heat resistant electric insulating resilient tube (5) is fitted onto the peripheral surface of the coated inductance device to form a high frequency coil in a one-body form.

The heat resistant electric insulating resilient tube (5) is preferably an insulating tube made of knitted glass fiber.

FIG. 4 is a sectional view of the other embodiment of the present invention. Each metallic plated layer (6) is formed on the surfaces of both ends of the rod ferrite magnetic core (1) by a silver plating etc. The metallic plated layers (6) at the ends of the ferrite magnetic core (1) are electrically connected through the coil and the electrode caps (3) are respectively fitted to the metallic plated layers (6) to form the electrodes for leading from the coil.

Figure 5:
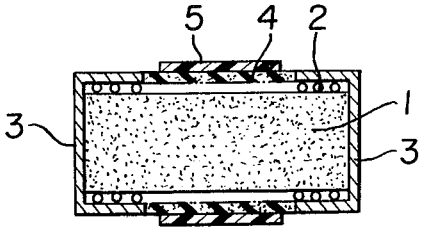
FIGS. 5 and 6 are respectively sectional views of the other embodiments of the high frequency coil of the present invention.

FIG. 5 is a sectional view of the other embodiment of the present invention.

When the high frequency coil is fitted into the ignition plug (10), the gap (g) is formed between the hollow insulator (11) and the high frequency coil to cause weak impact strength.

In the above-mentioned embodiment, shock is applied through the resilient tube (5) to the caps (3) whereby the shock highly affects to the caps (3) and the magnetic core in the caps (3) to cause loosening of the caps (3).

In this embodiment, the heat resistant electric insulating resilient tube (5) is fitted onto the heat resistant electric insulating coated layer (4) without holding the caps (3).

Figure 6:
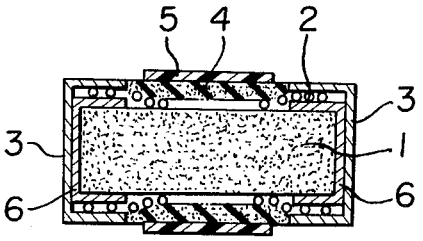

FIG. 6 is a sectional view of the other embodiment of the present invention. A metallic plated layer (6) is formed on the surfaces of both ends of the rod ferrite magnetic core (1) by a silver plating etc. The metallic plated layer (6) at the ends of the ferrite magnetic core (1) are electrically connected through the coil and the electrode caps (3) are respectively fitted to the metallic plated layers (6) to form the electrodes for the coil. The resilient tube (5) is fitted onto the heat resistant electric insulating coated layer (4) without holding the caps (3).

Referring to FIGS. 7 to 10, the other embodiments of the present invention will be illustrated.

When high shock is applied to the ignition plug, fine ferrite powder is formed on the surface of the ferrite magnetic core (1) in contact with the electrode caps (3)

and the fine ferrite powder is spread through the insulating coated layer (4) and the gap (g) between the hollow insulator (11) and the high frequency coil to adhere on the electrodes thereby causing trouble of conduction. This trouble may be caused by the following reason. An alumina type paint is usually used as the insulating coating paint (4) whereby many pinholes are formed on the surfaces of the coated layer in contact with the electrode caps (3) because of difference of thermal expansion coefficients of the coated layer and the metal in the heat-curing of the coated layer, and accordingly air-tightness can not be maintained to spread the fine ferrite powder through the pinholes.

In order to prevent such trouble, the heat resistant electric insulating tube (5) is fitted to cover the coated layer of the high frequency coil so as to prevent the spreading of the fine ferrite powder through the coated layer (4).

In the embodiments shown in FIGS. 7 to 10, the coated layer is formed by a heat resistant electric insulating glass and the heat resistant electric insulating resilient tube is fitted in a form of one or more rings so as to contact with the inner wall of the hollow insulator.

Figure 7:
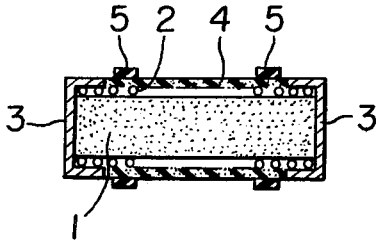
FIGS. 7, 8, 9 and 10 are respectively sectional views of the other embodiments of the high frequency coil of the present invention.

In FIG. 7, the winding (2) is wound in a spiral form on the peripheral surface of the rod ferrite magnetic core (1) and a pair of the electrode caps (3) are respectively fitted onto both ends of the magnetic core to form the inductance device and the heat resistant electric insulating glass coated layer (4) is formed on the peripheral surface of the inductance device and two of the heat resistant electric insulating resilient rings (5) are fitted onto the coated layer.

In the preparation of the high frequency coil, the winding of the bare wire is wound on the rod ferrite magnetic core (1) to form a coil. The metallic caps (3) are respectively fitted at both ends by pressing to form the inductance device. A glass paste (a paint obtained by dispersing glass components in an organic solvent) is coated on the whole surface of the inductance device and sintered in a furnace at high temperature such as 700° C. whereby the organic solvent is evaporated and the glass components are melted by the sintering to spread the molten glass frit into the gap between the coil and the ferrite magnetic core (1) and the gap between the electrode caps (3) and the coil and the glass frit is solidified by cooling to form the glass coated layer (4). The glass coated layer (4) has high affinity to the metal and pinholes are not substantially formed in the glass coated layer to maintain high air-tightness. Then, two heat resistant electric insulating resilient rings (5) such as silicone rubber insulating tube are fitted on the glass coated layer (4) with a space. The fitted product is heated to melt-bond the glass coated layer (4) with the rings (5) to obtain the high frequency coil. When the silicone rubber tube is used as the rings, the tube has excellent heat shrinking property whereby the air-tightness of the glass coated layer (4) is improved. The glass components are preferably selected to give a thermal expansion coefficient similar to that of the metallic cap. For example, lead powder is preferably incorporated. Typical glass components are glass frits for melt coatings, such as IWF frit No. 7570 and No. 7574 manufactured by Iwaki Glass Co. (high lead soldering glass containing lead oxide).

Figure 8:
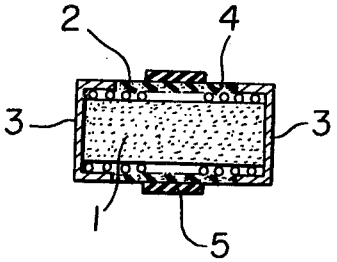

In the embodiment shown in FIG. 8, only one ring (5) is fitted as the resilient tube, onto the glass coated layer (4).

Figure 9:
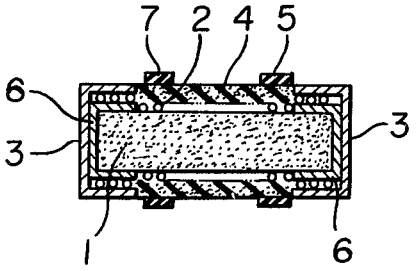
Figure 10:
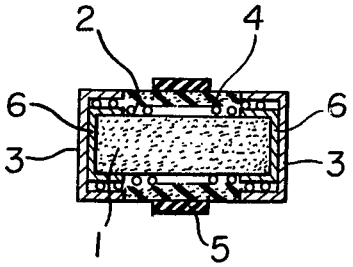

In the embodiments shown in FIGS. 9 and 10, a metal plated layer (6) is formed at both ends of the ferrite magnetic core and each electrode cap (3) is fitted onto the respective metal plated layer (6) to form the electrode for leading the coil and one or two of the rings are fitted onto the glass coated layer (4).

In accordance with the present invention, the high frequency coil has a simple structure and a desired kind of the heat resistant electric insulating resilient tube is fitted depending upon the purpose of the application whereby the high frequency coil has high impact strength and a long life and excellent applicability. When the high frequency coil is used for the ignition plug, it has excellent heat resistance and it can be economically obtained in low cost.

When the resilient tube is fitted onto only the surface of the insulating coated layer without holding the caps, shock is not directly applied to the electrode caps, whereby the impact strength is further improved.

When the glass coated layer is formed as the heat resistant electric insulating coated layer, especially the glass coated layer having a thermal expansion coefficient similar to that of the metal of the electrode cap and having high affinity to the metal, the formation of pinholes of the coated layer in contact with the electrode cap can be substantially prevented to maintain high air-tightness, and the spreading of the fine ferrite powder formed between the ferrite magnetic core and the electrode cap in the shock test can be prevented to prevent the trouble of electric conduction. The resilient tube fitted onto the high frequency coil is used for protection against the shock of the device.

When a width of the resilient tube is narrow, the cost can be low.

We claim:

1. An inductive high frequency coil, comprising:
- a ferrite magnetic core having a generally cylindrical shape defining opposite ends interconnected by means of a peripheral surface;
- a metallic layer plated on said opposite end portions and said peripheral surface adjacent thereto;
- a winding wound around said metallic layer plated on said ends and on said peripheral surface to form an inductive device having ends and a peripheral surface;
- a pair of end caps fitted on respective ends of said inductive device in contact with said metallic layer and covering at each of said ends a portion of said winding;
- a heat resistant electrically insulating layer coated on the peripheral surface of said inductive device; and
- a heat resistant electrically insulating resilient tube fitted onto said insulating layer.

2. The high frequency coil according to claim 1 wherein said heat resistant electrically insulating resilient tube is fitted on said heat resistant electrically insulating coated layer and not on the surfaces of said pair of said electrode caps.

3. The high frequency coil according to claim 1 wherein said heat resistant electrically insulating resilient tube is fitted on said heat resistant electrically insulating coated layer on both of said winding and said electrode caps.

4. The high frequency coil according to claims 1, 2 or 3 wherein said heat resistant electrically insulating coated layer is made of a heat resistant electrically insulating glass.

5. The high frequency coil according to claim 1 wherein said winding is wound in a spiral form.

6. The high frequency coil according to claim 4, comprising:

said heat resistant electrically insulating resilient tube comprises at least one ring formed around said heat resistant electrically insulating coated layer.

7. The high frequency coil according to claim 6, comprising:

plural of said rings spaced apart on said coated layer.

* * * * *